US007854311B2

(12) United States Patent
van der Werf et al.

(10) Patent No.: US 7,854,311 B2
(45) Date of Patent: Dec. 21, 2010

(54) ESCALATOR OR TRAVELATOR

(75) Inventors: Gerben van der Werf, Hamburg (DE); Frank Neerhut, Henstedt-Ulzburg (DE); Michael Tilkorn, Trittau (DE); Reiner Ludwig, Schwarzenbek (DE); Hartmuth Willnauer, Witzhave (DE)

(73) Assignee: ThyssenKrupp Fahrtreppen GmbH (DE)

( * ) Notice: Subject to any disclaimer, the term of this patent is extended or adjusted under 35 U.S.C. 154(b) by 0 days.

(21) Appl. No.: 12/280,981

(22) PCT Filed: May 14, 2007

(86) PCT No.: PCT/EP2007/004266

§ 371 (c)(1),
(2), (4) Date: Aug. 27, 2008

(87) PCT Pub. No.: WO2007/131757

PCT Pub. Date: Nov. 22, 2007

(65) Prior Publication Data

US 2009/0026038 A1 Jan. 29, 2009

(30) Foreign Application Priority Data

May 16, 2006 (DE) ..... 20 2006 007 833 U

(51) Int. Cl.
*B66B 21/02* (2006.01)

(52) U.S. Cl. ..... 198/326; 198/327

(58) Field of Classification Search ..... 198/321, 198/326, 331, 332, 333, 327
See application file for complete search history.

(56) References Cited

U.S. PATENT DOCUMENTS

| | | | | |
|---|---|---|---|---|
| 3,789,972 | A | 2/1974 | Kraft | |
| 4,235,326 | A * | 11/1980 | Nakao et al. | 198/326 |
| 4,519,490 | A | 5/1985 | White | |
| 4,726,463 | A * | 2/1988 | Babler | 198/333 |
| 6,471,034 | B2 * | 10/2002 | Lunardi et al. | 198/333 |
| 7,431,139 | B2 * | 10/2008 | Streibig et al. | 198/326 |
| 2007/0029161 | A1 * | 2/2007 | Streibig et al. | 198/326 |

FOREIGN PATENT DOCUMENTS

| | | |
|---|---|---|
| JP | 2001 010775 | 1/2001 |
| WO | WO2005/035422 | 4/2005 |

* cited by examiner

*Primary Examiner*—James R Bidwell
(74) *Attorney, Agent, or Firm*—Robert Becker; Robert Becker & Assoc.

(57) ABSTRACT

An escalator or travelator comprising a circulating step belt or panel belt. Each step or panel of a belt is provided on each side respectively with a supporting roller and a chain roller, which are guided on supporting roller rails and chain roller rails in forward travel and in return travel. Supporting roller return travel rails are adapted to support the supporting roller only partially.

21 Claims, 2 Drawing Sheets

ESCALATOR OR TRAVELATOR

BACKGROUND OF THE INVENTION

The instant application should be granted the priority dates of May 16, 2006, the filing date of the corresponding German patent application 20 2006 007 833.9, as well as May 14, 2007, the filing date of the international patent application PCT/EP2007/004266.

The invention relates to an escalator or a travelator (moving walkway).

The steps of escalators and the pallets or panels of travelators are usually supported by chain rollers and supporting rollers, which run on respectively assigned rails. In return travel, the steps or pallets must be transported upside down and at the ends of the travelator or escalator a reversal must respectively be made. this requires that the rollers and hence the respectively associated rails are mutually offset in a regular manner in the lateral direction. Thus the chain rollers with the chain roller rail generally run very far out in a lateral plane, while the supporting rollers run on another lateral plane, generally inwardly offset. This requires, on the other hand, that as a result of this lateral offset, the necessary overall width of the escalator or travelator increases in the lateral direction.

In order to prevent this, it has long been known to make the rollers and hence the associated rails run at least partially beneath the steps or pallets. This requires, on the other hand, an enlarged overall height of the escalator or travelator, which turns out to be significant, since the particular escalator or the particular travelator has then to be increased in overall height both with respect to the forward travel and with respect to the return travel. This measure runs counter in this regard to the desire for a slim escalator design, in particular in the region of the frame.

In order to obtain a reduced overall width without having in this regard to accept an increased overall height, it has already become known, for example from DE-OS-23 42 849, to provide the chain rollers right next to the particular step. Here too, the necessary reversal of the running of the step belt must, of course, be realized and the return travel here too requires the step band to be transported in the inverted position.

In order to realize a slim design of the escalator combined with a small overall height, it has already been proposed to realize the frame of the escalator as slim as possible and tight against the escalator rails. For example, in latticed frame structures, a support is ensured which is rigid and sag-proof, at the same time as the material usage remains low.

Although such a solution allows a relatively compact frame structure, the overall width of the overall height—depending on the chosen arrangement of the chain rollers or supporting rollers—is relatively large.

SUMMARY OF THE INVENTION

The object of the invention is therefore to provide an escalator or a travelator of the aforementioned general type, which, with respect to the overall height of the overall width, is improved relative to the known solutions without sacrifices having to be accepted with respect to the operating reliability of the escalator or travelator.

This object is realized by an escalator or travelator comprising a circulating step belt or panel belt, wherein each step or panel of a belt is provided on each side respectively with a supporting roller and a chain roller, which are guided on supporting roller rails and chain roller rails in forward travel and in return travel, and wherein supporting roller return travel rails are adapted to support the supporting roller only partially.

This object is realized by an escalator or travelator comprising a circulating step belt or panel belt, wherein each step or panel of a belt is provided on each side respectively with a supporting roller and a chain roller, which are guided on supporting roller rails and chain roller return travel rails are adapted to support the supporting roller only partially.

According to the invention, it is particularly favorable that a specific arrangement of the chain rollers allows the advantages of the hitherto alternative arrangements, i.e. either beneath or alongside the steps or pallets, to be combined:

The chain roller is disposed at the transition between the bottom side and the side face of the particular step or pallet, to be precise such that it projects somewhat over the step or the pallet both laterally and in the direction of the bottom side. the bottom side relates to the normal state, i.e. the state of the step or pallet in which the tread is at the top. This arrangement allows a more compact design to be realized, in spite of the full loading capacity, surprisingly with simple means:

In forward travel, the total width of the supporting roller is available for the support and the supporting roller rail can be realized correspondingly wide. This also allows the desired lateral tolerance to be provided, so that the width of the forward travel chain roller rail can be, for example, twice as large as the width of the chain roller and the chain roller finds a very wide path for its run-off.

According to the invention, it is provided for the return travel—unburdened by passengers and other weights—of the steps or panels to use only an outer part of the chain roller. The overall width of the escalator can be markedly reduced by this measure, especially as a corresponding reduction of the overall width can be provided according to the invention on both sides.

The reversing region of the escalator according to the invention can however be realized without constraint, the supporting roller rail for forward travel being able to be provided, at least up to the region of the comb plate, in full width and beneath the step or pallet.

For the return travel transport of the step or pallet, support on about half of the width of the supporting roller shall also suffice, and the overall height of the escalator or travelator according to the invention virtually corresponds to a solution comprising laterally extending chain rollers and supporting rollers.

BRIEF DESCRIPTION OF THE DRAWINGS

Further advantages, details and features emerge from the following description of two illustrative embodiments of the invention with reference to the drawing, wherein.

DESCRIPTION OF SPECIFIC EMBODIMENTS

Figure 1:
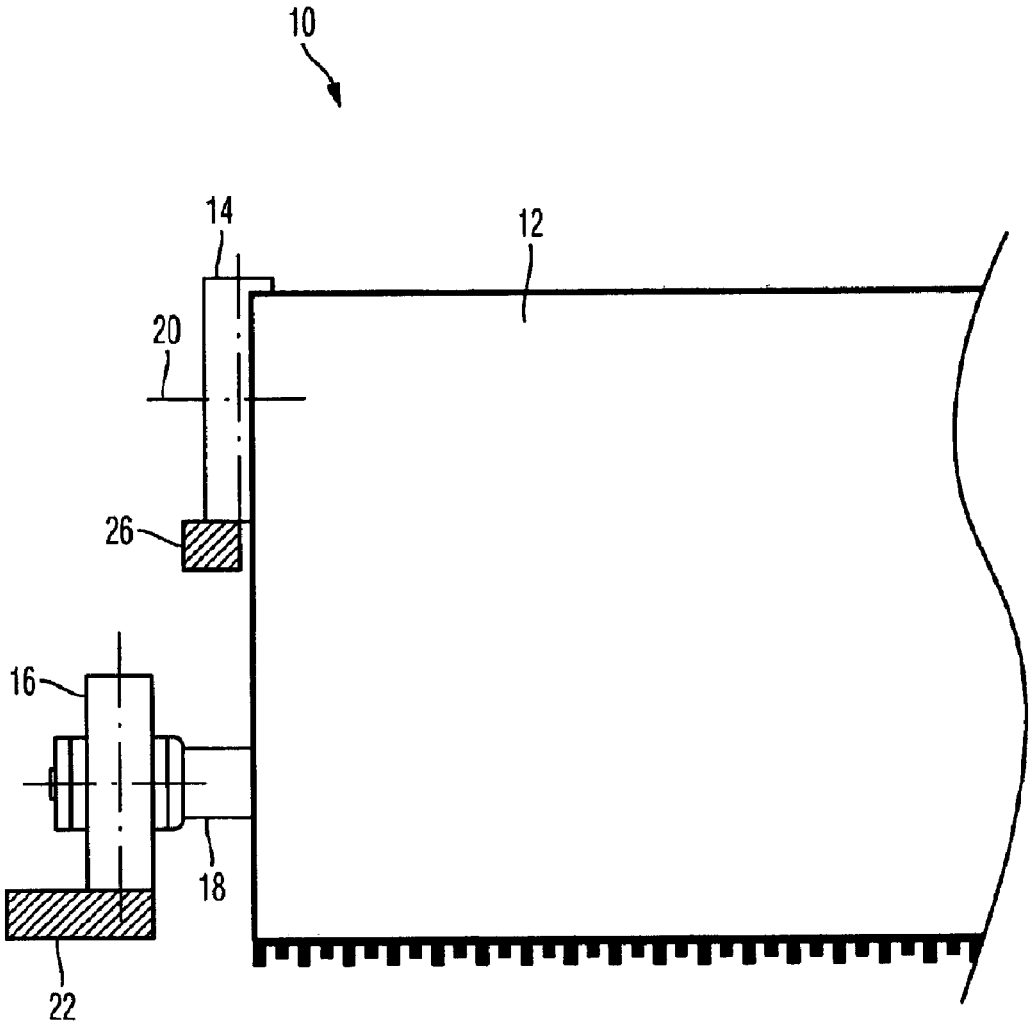
FIG. 1 shows a schematic view of a detail of an embodiment of an escalator according to the invention, the escalator step being shown in hanging or suspended representation.

An escalator 10 according to the invention has escalator steps, whereof an escalator step 12 is represented in FIG. 1. Each step has on each side respectively a supporting roller 14 and a chain roller 16, which are respectively mounted on axle or shaft stubs. The axle stub 18 of the chain roller 16 is visible from FIG. 1, while the particular axle stub of the supporting roller 14 is concealed by the representation of the step 12 and is indicated merely by the schematically illustrated axle or shaft 20 of the supporting roller 14.

The chain roller 16 is mounted in a manner which is known per se by the use of a chain roller rail 22. The chain roller rail 22 extends quite far out to the side and has an optional width and is, in particular, markedly wider than the chain roller 16.

In the situation according to FIG. 1, the chain roller 16 is supported on the inner half, i.e. the half facing the step 12, of the rail 22.

The supporting roller 14 protrudes somewhat relative to the escalator step 12—in the hanging or suspended representation according to FIG. 1—for example by about one-tenth of its diameter. The supporting roller 14 is mounted such that, in the front view of the escalator step 12 which is represented in FIG. 1, it overlaps the latter over a large area, for example over more than one-third, though in the extreme case the degree of overlap may also measure somewhat more than half of the area of the supporting roller 14—in the view according to FIG. 1.

According to the invention, the supporting roller 14 is supported on a supporting roller rail 26, which extends alongside the escalator step 12. The support is realized, however, such that only a part of the supporting roller 14 is supported in return travel, for example, the outer half or so of the supporting roller 14. This allows an all in all markedly narrower supporting roller rail 26 to be made available. Thus the chain roller rail 22 can also be disposed further inward, i.e. shifted in the direction of the escalator step 12, so that the overall width of the structure falls markedly relative to the known laterally mounted escalator steps.

Figure 2:
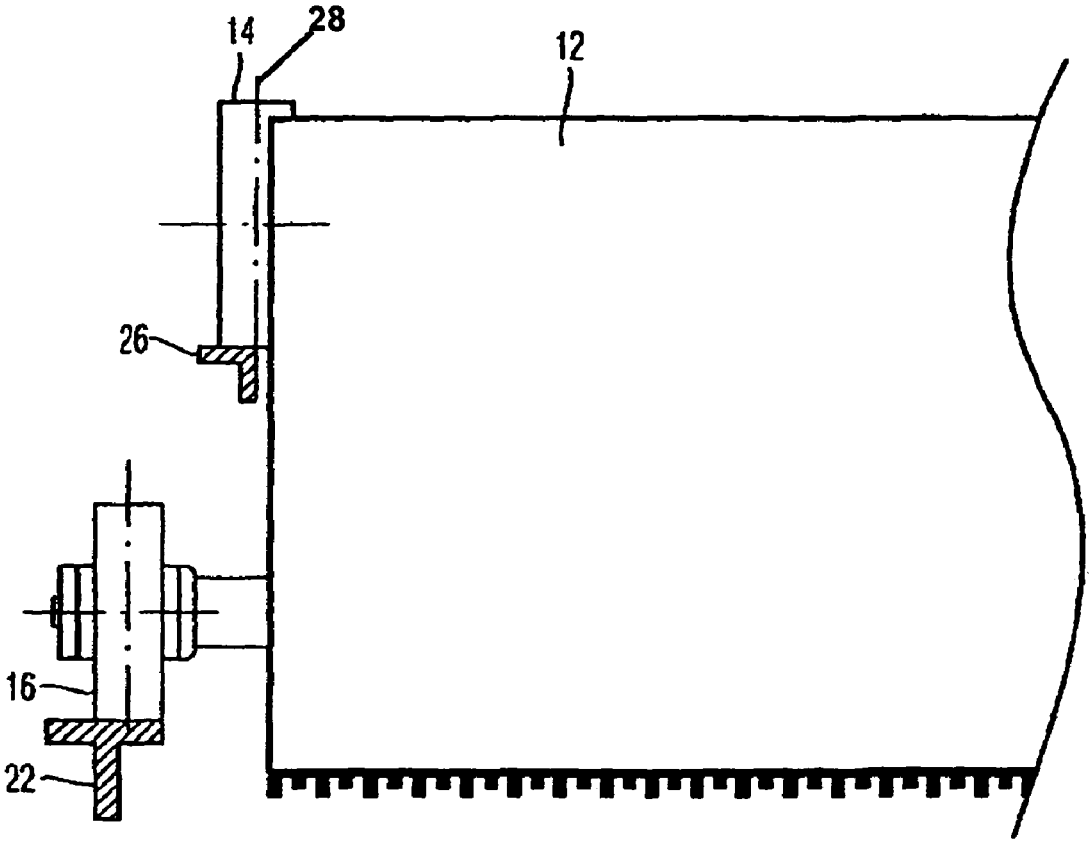
FIG. 2 shows a modified embodiment of the escalator according to the invention, in a representation corresponding to FIG. 1.

The rails 22 and 26 can be realized in any chosen suitable manner. A further realization option can be seen in the embodiment according to FIG. 2. There the supporting roller rail 26 is realized as an L-profile, the vertical member of the L extending adjacent to the center axis 28 of the supporting roller. The chain roller rail 22 is also reduced in its width. It is configured as a T-profile, the horizontal member forming the running tread or support surface for the chain roller 16. In this embodiment, the support provided by the vertical members ensures the necessary stability for both rails 22 and 26.

The specification incorporates by reference the disclosure of German 20 2006 007 833.9 filed May 16, 2006, as well as International application PCT/EP2007/004266, filed May 14, 2007.

The present invention is, of course, in no way restricted to the specific disclosure of the specification and drawings, but also encompasses any modifications within the scope of the appended claims.

The invention claimed is:

1. An escalator or travelator comprising a circulating step belt or panel belt, wherein each step or panel of a belt is provided on each side respectively with a supporting roller (14) and a chain roller (16), which are guided on supporting roller rails (26) and chain roller rails (22) in forward travel and in return travel, wherein said supporting roller rails extend alongside the escalator steps or travelator panels, and wherein supporting roller return travel rails (26) are adapted to support said supporting roller (14) only partially.

2. An escalator or travelator according to claim 1, wherein said supporting roller return travel rail (26) has a width that is less than a width of said supporting roller (14).

3. An escalator or travelator according to claim 2, wherein said width of said supporting roller return travel rail (26) is one fifth to two thirds less than said width of said supporting roller (14).

4. An escalator or travelator according to claim 2, wherein said supporting roller (14), as viewed in a front view of a step (12) or panel, is mounted such that said supporting roller partially overlaps the step or panel and protrudes both laterally and downwardly over the step or panel.

5. An escalator or travelator according to claim 4, wherein the degree of overlap between the step (12) or panel and said supporting roller (14), as viewed in a front view, is more than 20% and less than 70% of a width of said supporting roller (14).

6. An escalator or travelator according to claim 5, wherein the degree of overlap is about 40% of the width of said supporting roller (14).

7. An escalator or travelator according to claim 4, wherein said supporting roller (14) protrudes downwardly relative to the step (12) or panel by a few millimeters.

8. An escalator or travelator according to claim 7, wherein said supporting roller (14) protrudes downwardly by less than half of its diameter.

9. An escalator or travelator according to claim 8, wherein said supporting roller (14) protrudes downwardly by less than 20% of its diameter.

10. An escalator or travelator according to claim 9, wherein said supporting roller (14) protrudes downwardly by about one tenth of its diameter.

11. An escalator or travelator according to claim 1, wherein said supporting roller (14) is mounted to a bottom end of a step (12) or panel, and wherein a forward travel supporting roller rail is provided that extends partially beneath the step or panel.

12. An escalator or travelator according to claim 11, wherein a chain roller forward travel rail (22) extends laterally beyond, relative to the step (12) or panel, said supporting roller forward travel rail, directly adjacent to, yet vertically opposite from, said supporting roller forward travel rail.

13. An escalator or travelator according to claim 11, wherein inner sides of said chain roller rails and said supporting roller forward travel rail, i.e. on a side thereof facing the step (12) or panel, respectively extend substantially flush with an associated roller and, on an outer side, end clearly beyond the associated roller.

14. An escalator or travelator according to claim 13, wherein said chain roller rails and said supporting roller forward travel rail are substantially larger than the associated rollers.

15. An escalator or travelator according to claim 1, wherein said supporting roller return travel rail (26) extends beneath said supporting roller (14) in such a way that it supports approximately an outer half of said supporting roller (14).

16. An escalator or travelator according to claim 15, wherein said supporting roller return travel rail (26) supports about 40% of a width of said supporting roller (14).

17. An escalator or travelator according to claim 1, wherein said supporting roller return travel rail (26) has a width that is less than a width of said supporting roller (14).

18. An escalator or travelator according to claim 17, wherein the width of said supporting roller return travel rail (26) is between half and 90% of the width of said supporting roller (14).

19. An escalator or travelator according to claim 18, wherein the width of said supporting roller return travel rail (26) is about 80% of the width of said supporting roller (14).

20. An escalator or travelator according to claim 1, wherein return travel and forward travel rails are configured as L-rails or T-rails, and wherein vertical members of such rails respectively run substantially beneath a center of an associated roller.

21. An escalator or travelator according to claim 1, wherein said supporting roller rails extend laterally of the escalator steps or travelator panels.

* * * * *